US007285908B2

(12) United States Patent
Sakamoto et al.

(10) Patent No.: US 7,285,908 B2
(45) Date of Patent: Oct. 23, 2007

(54) ELECTROLUMINESCENT LIGHT EMITTING ELEMENT HAVING A METAL ELECTRODE LAYER, A LIGHT EMITTING LAYER AND AN OUTERMOST TRANSPARENT ELECTRODE LAYER

(75) Inventors: Gosuke Sakamoto, Kyoto (JP); Haruo Tanaka, Kyoto (JP)

(73) Assignee: Rohm Ltd., Kyoto-shi (JP)

( * ) Notice: Subject to any disclaimer, the term of this patent is extended or adjusted under 35 U.S.C. 154(b) by 48 days.

(21) Appl. No.: 10/397,987

(22) Filed: Mar. 26, 2003

(65) Prior Publication Data

US 2003/0193287 A1 Oct. 16, 2003

(30) Foreign Application Priority Data

Apr. 12, 2002 (JP) ..... 2002-110442

(51) Int. Cl.
*H01J 1/62* (2006.01)
*H05B 33/00* (2006.01)

(52) U.S. Cl. ..... 313/506; 313/504; 313/505; 313/498; 313/509; 428/690; 428/917

(58) Field of Classification Search ..... 313/500–506, 313/512; 438/99; 345/76–82
See application file for complete search history.

(56) References Cited

U.S. PATENT DOCUMENTS 5,714,838 A * 2/1998 Haight et al. ..... 313/506
5,969,474 A * 10/1999 Arai ..... 313/504
6,030,700 A * 2/2000 Forrest et al. ..... 428/336
6,365,270 B2 * 4/2002 Forrest et al. ..... 428/336
6,396,208 B1 * 5/2002 Oda et al. ..... 313/504
6,406,804 B1 * 6/2002 Higashi et al. ..... 428/690
6,476,550 B1 * 11/2002 Oda et al. ..... 313/504
6,476,783 B2 * 11/2002 Matthies et al. ..... 345/82
6,501,217 B2 * 12/2002 Beierlein et al. ..... 313/504
6,524,884 B1 * 2/2003 Kim et al. ..... 438/99
6,538,374 B2 * 3/2003 Hosokawa ..... 313/504
6,545,409 B2 * 4/2003 Kahen ..... 313/504
6,592,969 B1 * 7/2003 Burroughes et al. ..... 428/332
6,608,449 B2 * 8/2003 Fukunaga ..... 315/169.3
6,670,772 B1 * 12/2003 Arnold et al. ..... 315/169.3
2002/0014837 A1 * 2/2002 Kim et al. ..... 313/505
2003/0071569 A1 * 4/2003 Chung et al. ..... 313/512
2004/0075382 A1 * 4/2004 Stegamat et al. ..... 313/506

* cited by examiner

*Primary Examiner*—Sikha Roy
(74) *Attorney, Agent, or Firm*—Hedman & Costigan PC; James V. Costigan

(57) ABSTRACT

An electroluminescent light emitting element is equipped with a metal electrode layer, a light emitting layer capable of emitting light by electroluminescence, and a transparent electrode layer provided in that order on a substrate, wherein the light emitted by said light emitting layer is emitted from the side adjacent to said transparent electrode layer.

8 Claims, 8 Drawing Sheets

ELECTROLUMINESCENT LIGHT EMITTING ELEMENT HAVING A METAL ELECTRODE LAYER, A LIGHT EMITTING LAYER AND AN OUTERMOST TRANSPARENT ELECTRODE LAYER

BACKGROUND OF THE INVENTION

1. Field of the Invention

The present invention is related to an electroluminescent light emitting element which uses light emitted by electroluminescence, and a manufacturing method thereof.

2. Description of the Related Art

Electroluminescent light emitting elements are expected to have applications to flat panel displays. In applications to displays, it is important that the emitted light have high luminance and high luminous efficacy.

FIG. 1 shows the structure of a related art electroluminescent light emitting element. In this structure, a transparent electrode layer 32, a light emitting layer 33 and a metal electrode layer 34 are laminated in that order onto a glass substrate 31. When an electric field is applied between the transparent electrode layer 32 and the metal electrode layer 34, light is emitted from the light emitting layer 33 by electroluminescence. This emitted light is emitted into the air 30 after passing through the transparent electrode layer 32 and the glass substrate 31.

However, there is a large difference between the index of refraction of the glass substrate 31 and the index of refraction of the air 30, and when the incidence angle from the glass substrate 31 to the air 30 is greater than or equal to the critical angle for total reflection, the light emitted from the light emitting layer 33 can not be emitted into the air 30. Because the index of refraction of a glass substrate is normally about 1.5, the critical angle from the glass substrate 31 to the air 30 is approximately 42 degrees. Any light propagating inside the glass substrate 31 having an incidence angle greater than or equal to this critical angle will be confined inside the glass substrate 31 and the like. Due to the effect of this confinement, a large portion of light can not be emitted into the air 30 from the glass substrate 31. Consequently, there has been a desire to reduce as much as possible the effect of confinement to the glass substrate in order to emit electroluminescent light efficiently into the air.

Further, because the light emitting layer 33, the transparent electrode layer 32, the glass substrate layer 31 and the air 30 all have different indexes of refraction, reflected light is created due to the difference in the index of refraction at each of the boundaries from the light emitting layer 33 to the transparent electrode layer 32, from the transparent electrode layer 32 to the glass substrate 31, and from the glass substrate 31 to the air 30. When reflected light is created, because the electroluminescent light is attenuated, it is not possible to emit light efficiently into the air. Consequently, there has been a desire to reduce as much as possible the number of times that the electroluminescent light passes through a medium having a different index of refraction in order to emit electroluminescent light efficiently into the air.

SUMMARY OF THE INVENTION

In order to solve the problems of the related art described above, it is an object of the present invention to provide an electroluminescent light emitting element which can emit electroluminescent light efficiently into the air, and a manufacturing method thereof.

In order to achieve the object stated above, the invention provides an electroluminescent light emitting element equipped with a metal electrode layer, a light emitting layer capable of emitting light by electroluminescent, and a transparent electrode layer provided in that order on a substrate, wherein the light emitted by the light emitting layer is emitted from the side adjacent to the transparent electrode layer.

Accordingly, because the number of times that the electroluminescent light passes through a medium having a different index of refraction can be reduced, it is possible to reduce the attenuation of electroluminescent light due to reflection.

The invention also provides an electroluminescent light emitting element, wherein the thickness of the transparent electrode layer is made thinner that the wavelength of the light emitted by the light emitting layer.

By the effusion of light according to wave optics, the electroluminescent light emitted by the light emitting layer can be emitted from the light emitting layer directly to the outside.

The invention also provides an electroluminescent light emitting element of, wherein the sum of the thickness of the light emitting layer and the thickness of the transparent electrode layer is made thinner than the wavelength of the light emitted by the light emitting layer.

By the effusion of light according to wave optics, the electroluminescent light emitted by the light emitting layer can be emitted more efficiently from the light emitting layer directly to the outside.

The invention also provides an electroluminescent light emitting element equipped with a light emitting layer capable of emitting light by electroluminescence, and a transparent electrode layer provided in that order on a metal substrate, wherein the light emitted by the light emitting layer is emitted form the side adjacent to the transparent electrode layer.

Accordingly, because the number of times that the electroluminescent light passes through a medium having a different index of refraction can be reduced, it is possible to reduce the attenuation of electroluminescent light due to reflection. Further, because the metal substrate can also be used as a metal electrode, it is possible to simplify the structure of the electroluminescent light emitting element.

The invention also provides an electroluminescent light emitting element, wherein the thickness of the transparent electrode layer is made thinner than the wavelength of the light emitted by the light emitting layer.

By the effusion of light according to wave optics, the electroluminescent light emitted by the light emitting layer can be emitted from the light emitting layer directly to the outside.

The invention also provides an electroluminescent light emitting element, wherein the sum of the thickness of the light emitting layer and the thickness of the transparent electrode layer is made thinner than the wavelength of the light emitted by the light emitting layer.

By the effusion of light according to wave optics, the electroluminescent light emitted by the light emitting layer can be emitted more efficiently from the light emitting layer directly to the outside.

The invention also provides an electroluminescent light emitting element, wherein the transparent electrode layer is coated with a nonreflective film.

Accordingly, the nonreflective coating makes it possible to reduce the attenuation of electroluminescent light due to reflection.

The invention also provides an electroluminescent light emitting element, wherein a metal electrode grid is provided on the top surface of the transparent electrode layer.

Accordingly, the metal electrode grid makes it possible to avoid voltage drop even when the transparent electrode has a high resistance value.

The invention provides a method of manufacturing the electroluminescent light emitting element of, wherein the transparent electrode material is formed to have the thickness of the metal electrode grid, and then etching is carried out so that the etched portion forms the transparent electrode layer, and the remaining portion forms the metal electrode grid.

By forming the metal grid in this way, it is possible to simplify the process of manufacturing an electroluminescent light emitting element.

The invention also provides an electroluminescent light emitting element equipped with a reflection layer, a first transparent electrode layer, a light emitting layer capable of emitting light by electroluminescence, and a second transparent electrode layer provided in that order on a substrate, wherein the light emitted by the light emitting layer is emitted from the side adjacent to the second transparent electrode layer.

Accordingly, because the number of times that the electroluminescent light passes through a medium having a different index of refraction can be reduced, it is possible to reduce the attenuation of electroluminescent light due to reflection. Further, the reflection layer makes it possible to emit electroluminescent light efficiently to the outside.

The invention also provides an electroluminescent light emitting element, wherein the thickness of the second transparent electrode layer is made thinner than the wavelength of the light emitted by the light emitting layer.

By the effusion of light according to wave optics, the electroluminescent light emitted by the light emitting layer can be emitted from the light emitting layer directly to the outside.

The invention also provides an electroluminescent light emitting element, wherein the sum of the thickness of the light emitting layer and the thickness of the second transparent electrode layer is made thinner than the wavelength of the light emitted by the light emitting layer.

By the effusion of light according to wave optics, the electroluminescent light emitted by the light emitting layer can be emitted more efficiently from the light emitting layer directly to the outside.

The invention provides an electroluminescent light emitting element , wherein the second transparent electrode layer is coated with a nonreflective film.

Accordingly, the nonreflective coating makes it possible to reduce the attenuation of electroluminescent light due to reflection.

The invention provides electroluminescent light emitting element , wherein a metal electrode grid is provided on the top surface of the second transparent electrode layer.

Accordingly, the metal electrode grid makes it possible to avoid voltage drops even when the transparent electrode has a high resistance value.

The invention provides a method of manufacturing the electroluminescent light emitting element, wherein the transparent electrode material is formed to have the thickness of the metal electrode grid, and then etching is carried out so that the etched portion forms the transparent electrode layer, and the remaining portion forms the metal electrode grid.

By forming the metal grid in this way, it is possible to simplify the process of manufacturing an electroluminescent light emitting element.

DETAILED DESCRIPTION OF THE PREFERRED EMBODIMENTS

The preferred embodiments of the present invention will now be described in detail with reference to the drawings.

First Embodiment

Figure 1:
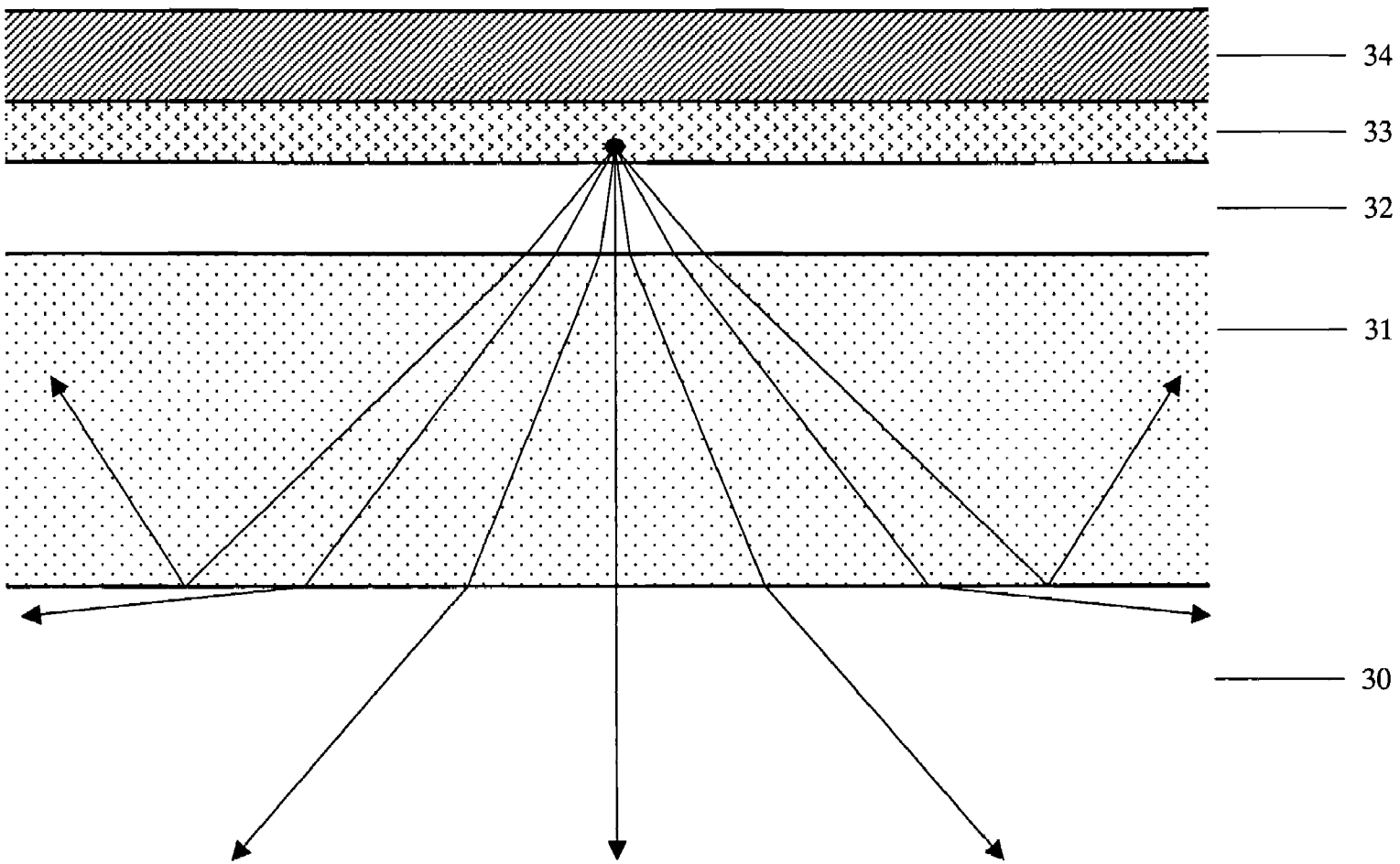
Fig.1 Prior Art
FIG. 1 is a schematic drawing showing the structure of a related art electroluminescent light emitting element.
Figure 2:
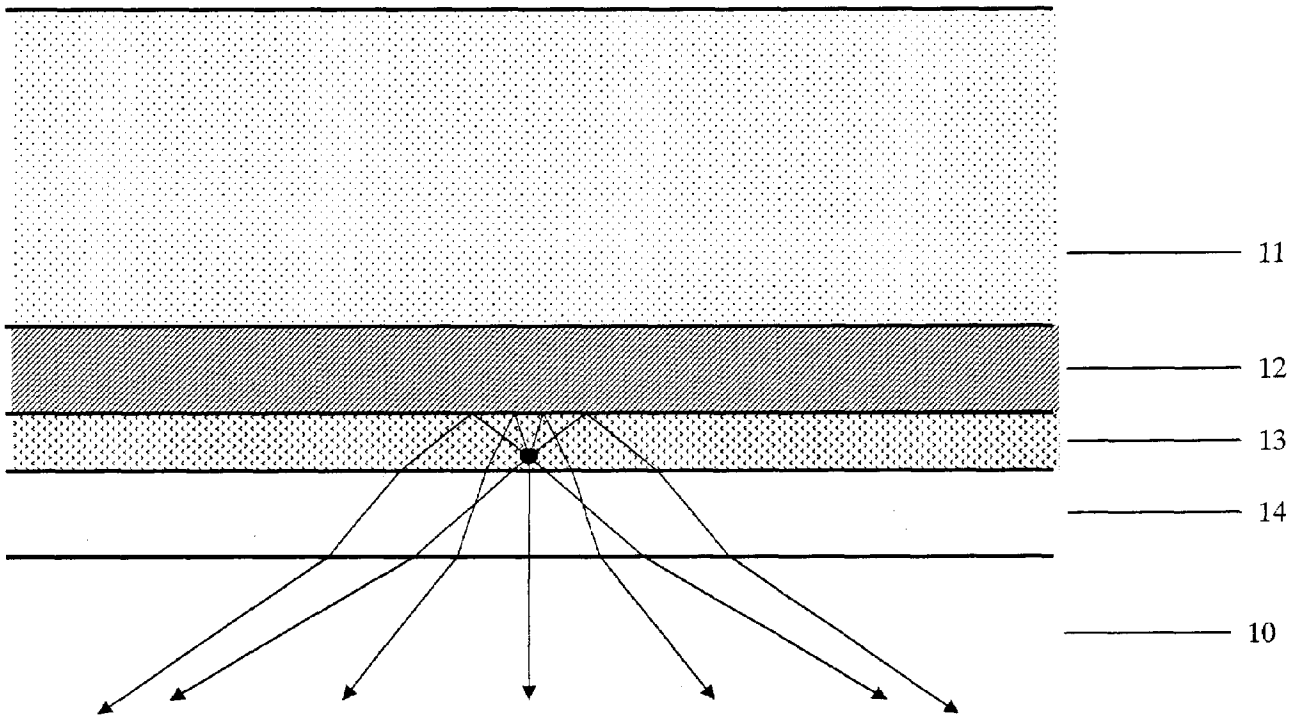
FIG. 2 is a schematic drawing showing the structure of an electroluminescent light emitting element of the present invention.

FIG. 2 shows a first embodiment of the present invention. In FIG. 2, an electroluminescent light emitting element is constructed by laminating a metal electrode layer 12, a light emitting layer 13 capable of emitting light by electroluminescence, and a transparent electrode layer 14 in that order onto a glass substrate 11. When an electric field is applied between the transparent electrode layer 14 and the metal electrode layer 12, electroluminescent light is emitted by the light emitting layer 13. From this emitted light, the light directed toward the transparent electrode layer 14 passes through the transparent electrode layer 14 and is emitted into the air 10, and the light directed toward the metal electrode layer 12 is reflected by the metal electrode layer 12 and then emitted into the air 10 after passing through the transparent electrode layer 14. When both the metal electrode layer 12 and the transparent electrode layer 14 are formed to have orthogonal stripe shapes, an electroluminescent light emitting element capable of displaying images is formed.

Each time the light is incident on a medium having a different index of refraction, reflected light is created due to such difference in the index of refraction, and this attenuates the advancing light. Accordingly, compared to the related art structure, because the number of times that the electroluminescent light passes through a medium having a different index of refraction is reduced by an arrangement in which the electroluminescent light passes from the light emitting layer to the transparent electrode layer, and then from the transparent electrode layer to the air, it is possible to reduce the attenuation of electroluminescent light due to reflection.

In this regard, when the thickness of the transparent electrode layer 14 is made thinner than the wavelength of the light emitted by the light emitting layer 13, then by the effusion of light according to wave optics, the electroluminescent light generated inside the light emitting layer 13 near the transparent electrode layer 14 can be emitted directly from the light emitting layer 13 into the air 10.

Further, when the sum of the thickness of the light emitting layer 13 and the thickness of the transparent electrode layer 14 is made thinner than the wavelength of the light emitted by the light emitting layer 13, then by the effusion of light according to wave optics, the electroluminescent light can be emitted directly from the light emitting layer 13 into the air 10. The light reflected by the metal electrode layer 12 can also be emitted directly from the light emitting layer 13 into the air 10.

Accordingly, compared to the related art structure, because the effect of such arrangement is equivalent to there being no passage of the electroluminescent light through a medium having a different index of refraction, the attenuation of electroluminescent light due to reflection is eliminated. Further, by using the effusion of light according to wave optics to emit light directly from the light emitting layer into the air, the confinement effect due to the critical angle is reduced, and this makes it possible to emit electroluminescent light efficiently into the air.

Second Embodiment

Figure 3:
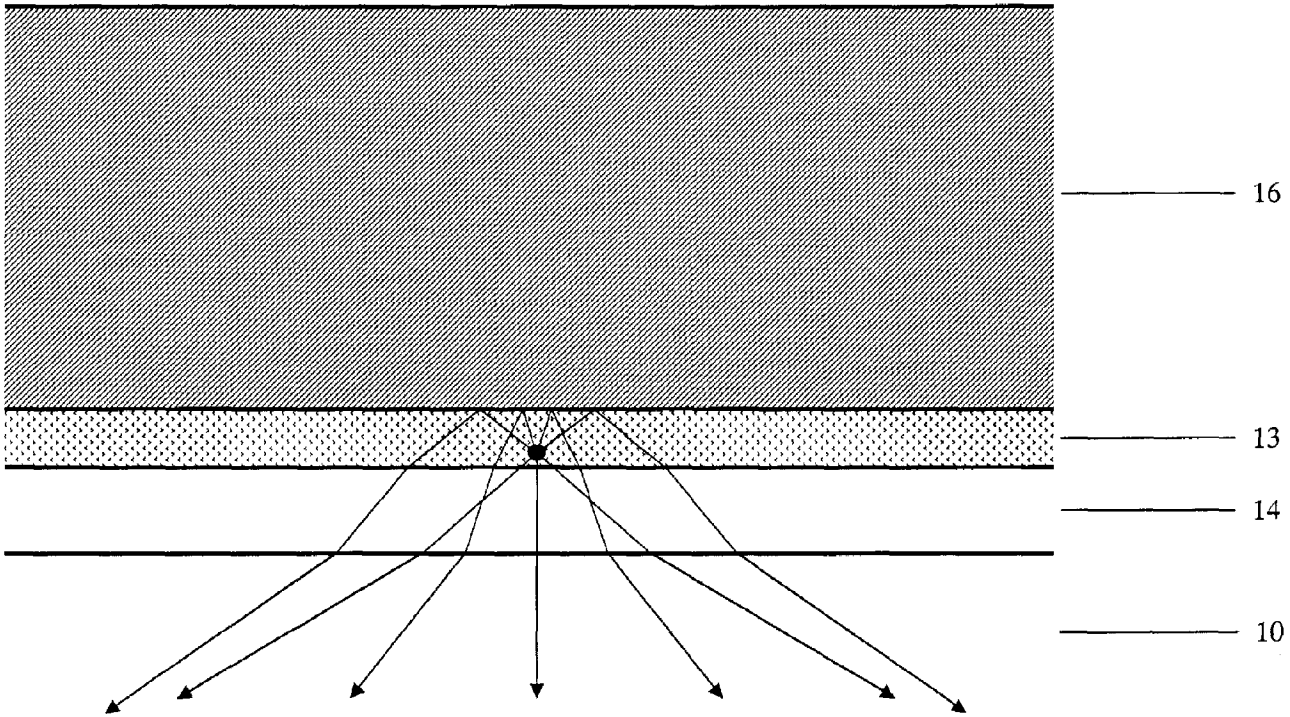
FIG. 3 is a schematic drawing showing the structure of an electroluminescent light emitting element of the present invention.

FIG. 3 shows a second embodiment of the present invention. In FIG. 3, an electroluminescent light emitting element is constructed by laminating a light emitting layer 13 capable of emitting light by electroluminescence, and a transparent electrode layer 14 in that order onto a metal substrate 16. When an electric field is applied between the metal substrate 16 and the transparent electrode layer 14, electroluminescent light is emitted by the light emitting layer 13. From this emitted light, the light directed toward the transparent electrode layer 14 passes through the transparent electrode layer 14 and is emitted into the air 10, and the light directed toward the metal substrate 16 is reflected by the metal substrate 16 and then emitted into the air 10 after passing through the transparent electrode layer 14.

Accordingly, compared to the related art structure, because the number of times that the electroluminescent light passes through a medium having a different index of refraction is reduced by an arrangement in which the electroluminescent light passes from the light emitting layer to the transparent electrode layer, and then from the transparent electrode layer to the air, it is possible to reduce the attenuation of electroluminescent light due to reflection.

In this regard, when the thickness of the transparent electrode layer 14 is made thinner than the wavelength of the light emitted by the light emitting layer 13, then by the effusion of light according to wave optics, the electroluminescent light generated inside the light emitting layer 13 near the transparent electrode layer 14 can be emitted directly from the light emitting layer 13 into the air 10.

Further, when the sum of the thickness of the light emitting layer 13 and the thickness of the transparent electrode layer 14 is made thinner than the wavelength of the light emitted by the light emitting layer 13, then by the effusion of light according to wave optics, the electroluminescent light can be emitted directly from the light emitting layer 13 into the air 10. The light reflected by the metal substrate 16 can also be emitted directly from the light emitting layer 13 into the air 10.

Accordingly, compared to the related art structure, because the effect of such arrangement is equivalent to there being no passage of the electroluminescent light through a medium having a different index of refraction, the attenuation of electroluminescent light due to reflection is eliminated. Further, by using the effusion of light according to wave optics to emit light directly from the light emitting layer into the air, the confinement effect due to the critical angle is reduced, and this makes it possible to emit electroluminescent light efficiently into the air.

Further, because the metal substrate 16 can also be used as a metal electrode, it is possible to simplify the structure of the electroluminescent light emitting element.

Third Embodiment

Figure 4:
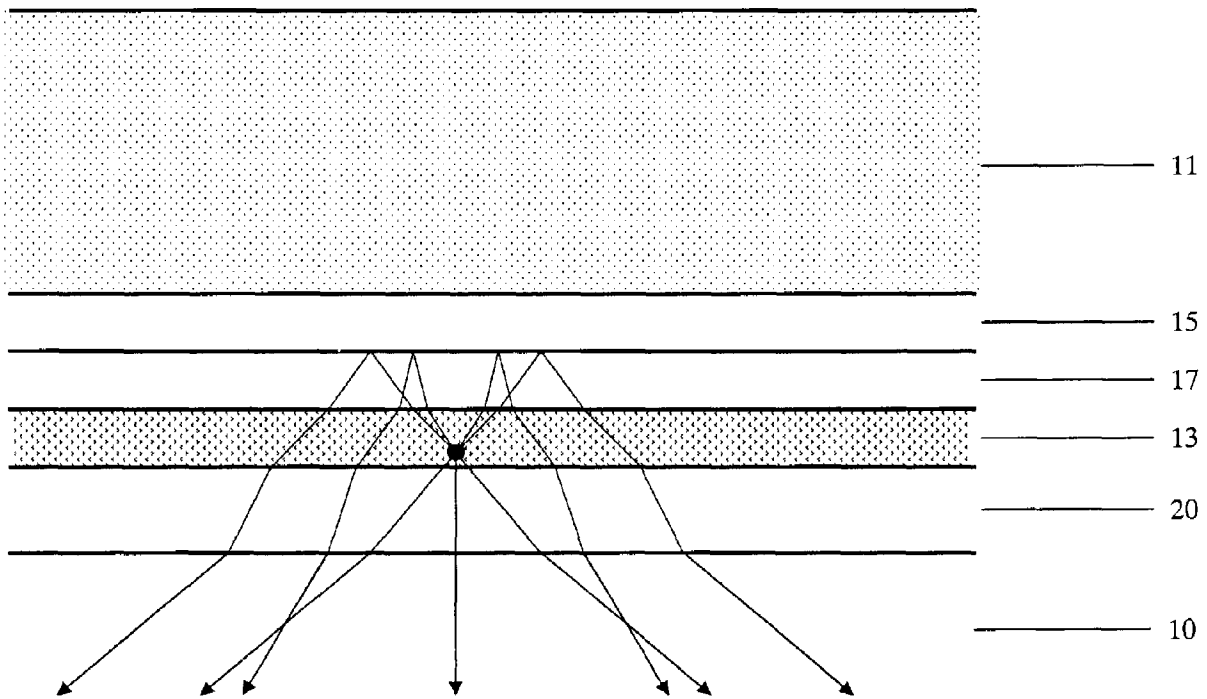
FIG. 4 is a schematic drawing showing the structure of an electroluminescent light emitting element of the present invention.

FIG. 4 shows a third embodiment of the present invention. In FIG. 4, an electroluminescent light emitting element is constructed by laminating a reflection layer 15, a first transparent electrode layer 17, a light emitting layer 13 capable of emitting light by electroluminescence, and a second transparent electrode layer 20 in that order onto a glass substrate 11. When an electric field is applied between the first transparent electrode layer 17 and the second transparent electrode layer 20, electroluminescent light is emitted by the light emitting layer 13. Among this emitted light, the light directed toward the second transparent electrode layer 20 passes through the second transparent electrode layer 20 and is emitted to the outside, and the light directed toward the first transparent electrode layer 17 is reflected by the reflection layer 15 and then emitted into the air 10 after passing through the second transparent electrode layer 20. When both the first transparent electrode layer 17 and the second transparent electrode layer 20 are formed to have orthogonal stripe shapes, an electroluminescent light emitting element capable of displaying images is formed.

Accordingly, compared to the related art structure, because the number of times that the electroluminescent light passes through a medium having a different index of refraction is reduced by an arrangement in which the electroluminescent light passes from the light emitting layer to the transparent electrode layer, and then from the transparent electrode layer to the air, it is possible to reduce the attenuation of electroluminescent light due to reflection.

In this regard, when the thickness of the second transparent electrode layer 20 is made thinner than the wavelength of the light emitted by the light emitting layer 13, then by the effusion of light according to wave optics, the electroluminescent light generated inside the light emitting layer 13 near the second transparent electrode layer 20 can be emitted directly from the light emitting layer 13 into the air 10.

Further, when the sum of the thickness of the light emitting layer 13 and the thickness of the second transparent electrode layer 14 is made thinner than the wavelength of the light emitted by the light emitting layer 13, then by the effusion of light according to wave optics, the electroluminescent light can be emitted directly from the light emitting layer 13 into the air 10. The light reflected by the reflection layer 15 can also be emitted directly from the light emitting layer 13 into the air 10.

Accordingly, compared to the related art structure, because the effect of such arrangement is equivalent to there being no passage of the electroluminescent light through a medium having a different index of refraction, the attenuation of electroluminescent light due to reflection is eliminated. Further, by using the effusion of light according to wave optics to emit light directly from the light emitting layer into the air, the confinement effect due to the critical angle is reduced, and this makes it possible to emit electroluminescent light efficiently into the air.

Further, if the reflection layer 15 is given a high reflectance, because the reflectance can be made higher than that of a metal electrode layer, it is possible to emit electroluminescent light more efficiently to the outside.

Fourth Embodiment

Figure 5:
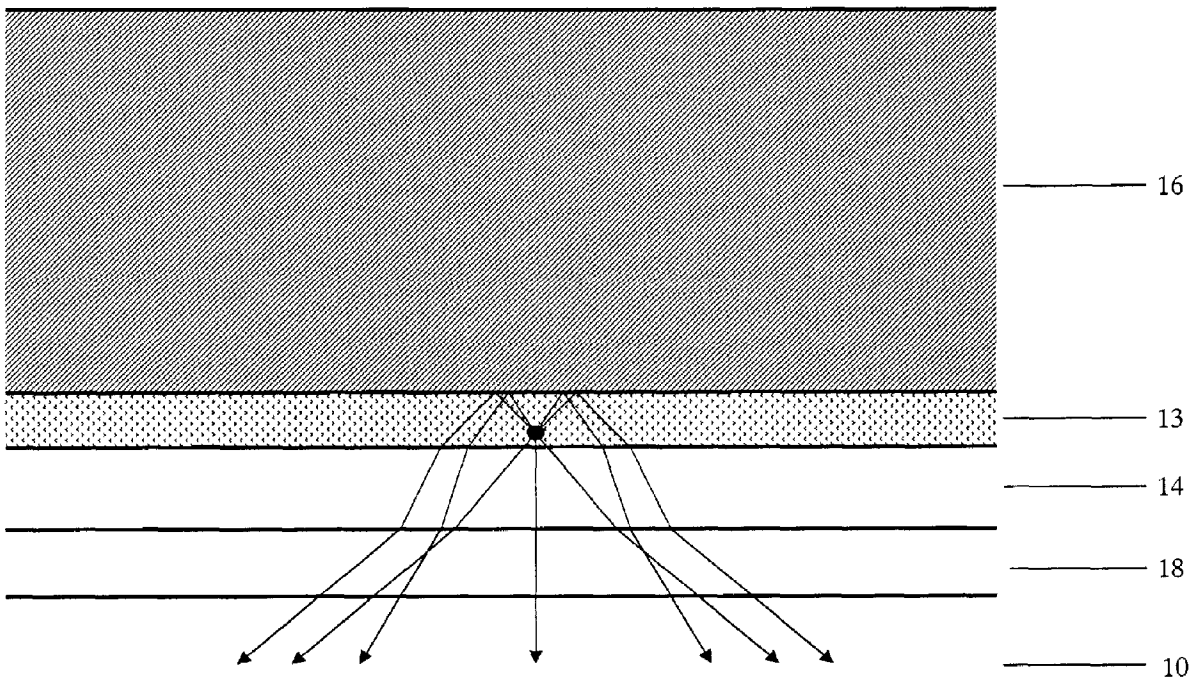
FIG. 5 is a schematic drawing showing the structure of an electroluminescent light emitting element of the present invention.

FIG. 5 shows a fourth embodiment of the present invention. The present embodiment is constructed by adding a nonreflective coating to the second embodiment. Namely, in FIG. 5, an electroluminescent light emitting element is constructed by laminating a light emitting layer 13 capable of emitting light by electroluminescence, and a transparent electrode layer 14 in that order onto a metal substrate 16, and then coating the transparent electrode layer 14 with a nonreflective coating film 18. When an electric field is applied between the metal substrate 16 and the transparent electrode layer 14, electroluminescent light is emitted by the light emitting layer 13. Among this emitted light, the light directed toward the transparent electrode layer 14 passes through the transparent electrode layer 14 and the nonreflective coating film 18 and is then emitted into the air 10, and the light directed toward the metal substrate 16 is reflected by the metal substrate 16 and then emitted into the air 10 after passing through the transparent electrode layer 14 and the nonreflective coating film 18.

Accordingly, compared to the related art structure, because a nonreflective coating is provided on the transparent electrode layer, it is possible to reduce the attenuation of electroluminescent light due to reflection.

Further, because the metal substrate 16 can also be used as a metal electrode, it is possible to simplify the structure of the electroluminescent light emitting element.

In addition to the second embodiment, the nonreflective coating provided on the transparent electrode through which the electroluminescent light is emitted of the present embodiment can also be applied to the first embodiment and the third embodiment to make it possible to reduce the attenuation of electroluminescent light due to reflection.

Fifth Embodiment

In the first through fourth embodiments, in the case where the transparent electrode layer 14 or the second transparent electrode layer 20 is made thin, the resistance value of the transparent electrode layer 14 or the second transparent electrode layer 20 will increase. When the resistance value of the transparent electrode increases, there is a voltage drop that makes it impossible to apply a sufficient electric field to the light emitting layer 13, and this reduces the luminous efficacy. Further, because the voltage drop happens in different locations, the voltage applied to the light emitting layer becomes nonuniform, and this causes the emitted light to also become nonuniform.

Figure 6:
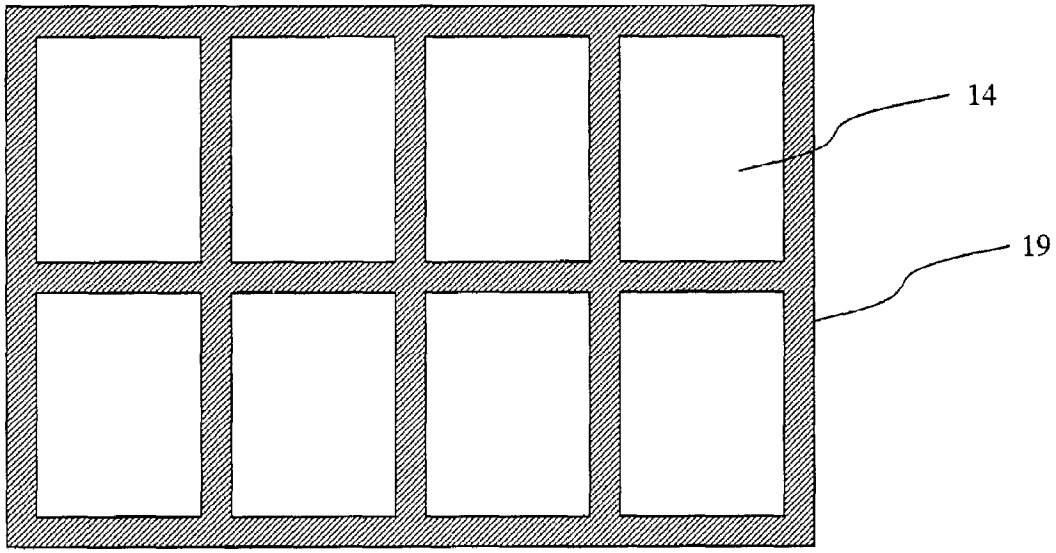
FIG. 6 is a schematic drawing showing the structure of a metal electrode grid applied to an electroluminescent light emitting element of the present invention.
Figure 7:
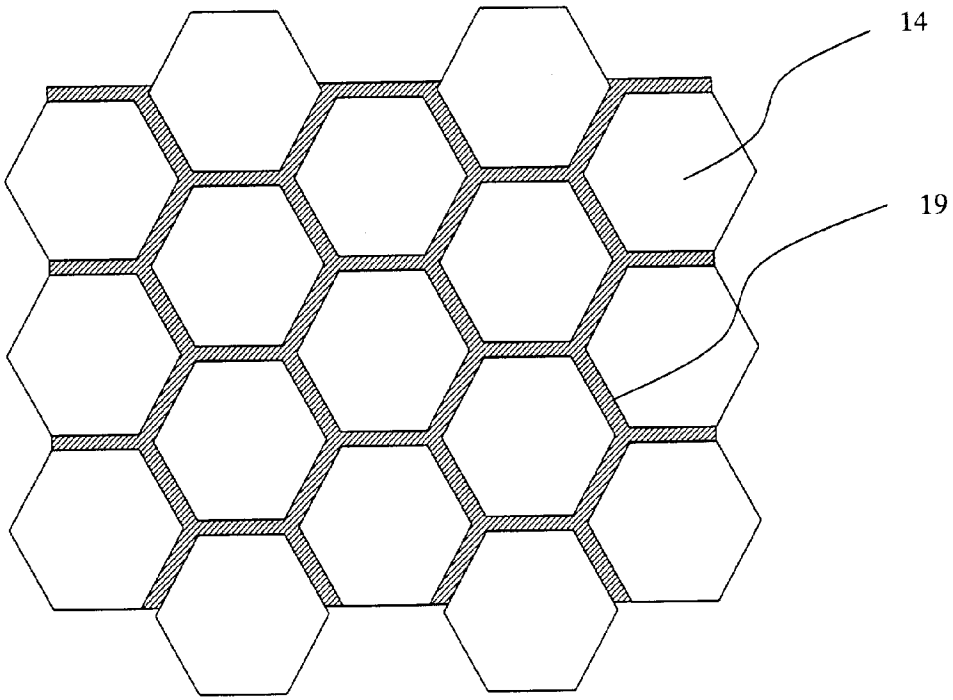
FIG. 7 is a schematic drawing showing the structure of another metal electrode grid applied to an electroluminescent light emitting element of the present invention.

In this regard, an electroluminescent light emitting element was constructed to make it possible to avoid voltage drops even when the transparent electrode layer 14 or the second transparent electrode layer 20 is made thin. Namely, FIG. 6 shows the electrode structure of the present embodiment. In FIG. 6, a metal electrode grid 19 is arranged on the surface of the transparent electrode layer 14. Because the metal electrode grid 19 ensures sufficient thickness, the resistivity is small compared to the transparent electrode layer 14, and this makes it possible to avoid voltage drops. The shape of the metal electrode grid 19 is not limited to the lattice shape shown in FIG. 6, and it is possible to use the honeycomb shape shown in FIG. 7. However, both these shapes are representative examples, and it is possible to use any shape that covers the transparent electrode.

This addition of a metal electrode grid to the surface of the transparent electrode layer can be applied to any of the inventions of the claims 1~5. In particular, because the transparent electrode layer is made thin, there is a large effect when the metal electrode grid is applied in the case where the transparent electrode has a large resistance value.

If the area ratio of the metal electrode grid is made large, it is possible to avoid voltage drops, but on the other hand, when the area ratio of the metal electrode grid is made large, the electroluminescent light emitted by the light emitting layer can not be emitted efficiently into the air. The area ratio of the metal electrode grid refers to the area percentage of the metal electrode grid occupying the surface of the transparent electrode layer. In this regard, if the area ratio of the metal electrode grid with respect to the surface of the transparent electrode layer or the second transparent electrode layer through which the electroluminescent light is emitted is made 30% or lower, the emission efficiency can be increased without degradation, and it is also possible to avoid voltage drops.

Accordingly, the present embodiment makes it possible to avoid voltage drops due to the transparent electrode having a high resistance.

Sixth Embodiment

The present embodiment is a method of manufacturing an electroluminescent light emitting element provided with the metal electrode grid of the fifth embodiment. The process of manufacturing an electroluminescent light emitting element according to the present embodiment is shown in FIG. 8.

Figure 8:
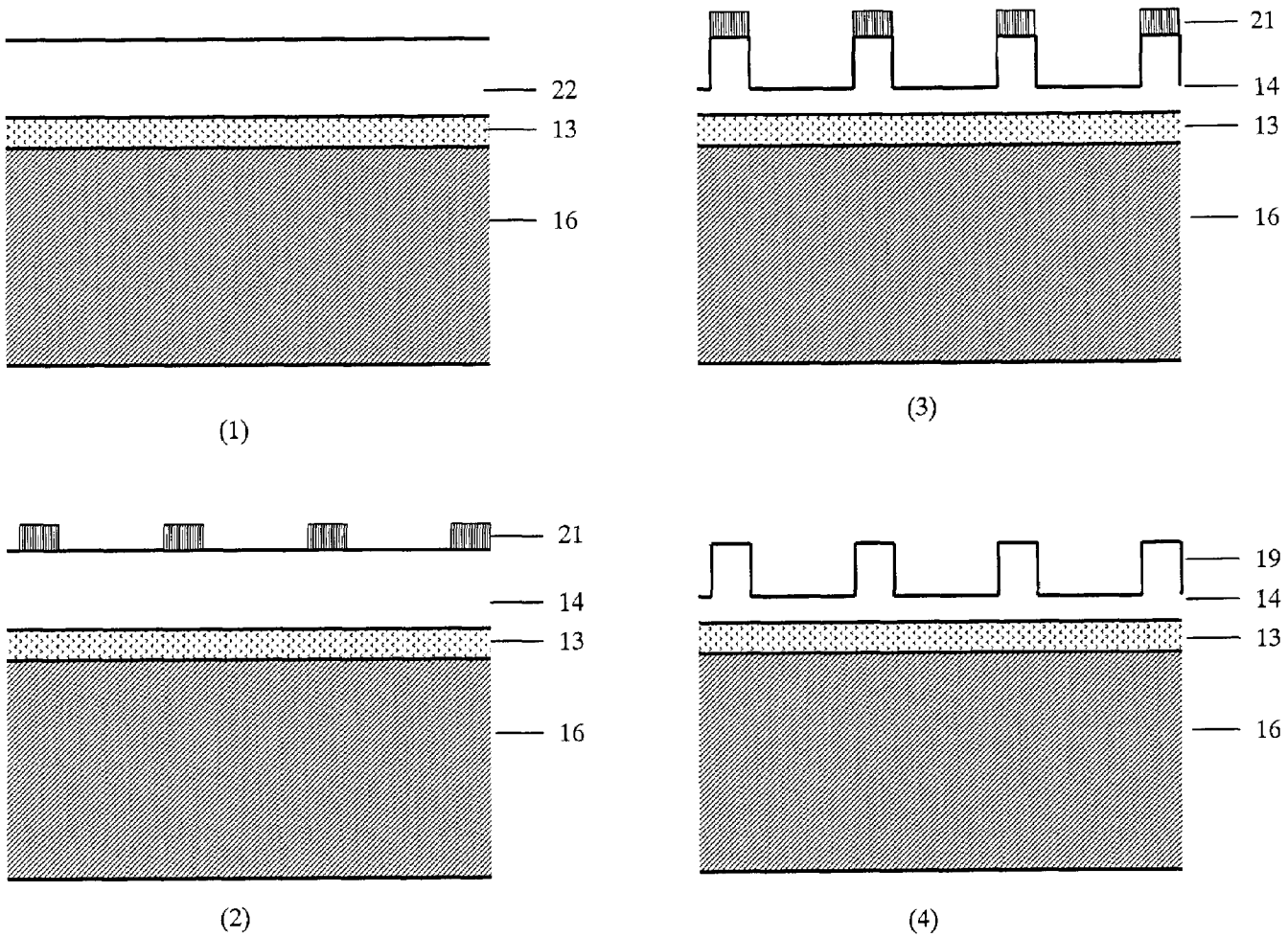
FIG. 8 is a process drawing showing a method of manufacturing a metal electrode grid applied to an electroluminescent light emitting element of the present invention.

In FIG. 8, the drawings (1)~(4) show the order of the manufacturing process. First, a light emitting layer 13 capable of emitting light by electroluminescence, and a transparent electrode material 22 is formed on a metal substrate 16 (FIG. 8(1)). The thickness of the transparent electrode material is made the same as the thickness of the metal electrode grid 19 at the final step. Next, a metal electrode grid pattern is formed by a photomask having a prescribed shape (FIG. 8(2)). Then, a transparent electrode layer having a prescribed thickness is created by etching which leaves behind a portion that will become the metal electrode grid 19 (FIG. 8(3)). Finally, the photomask is removed to obtain a thin transparent electrode layer 14 and a metal electrode grid 19 having a low resistance value (FIG. (4)). In this connection, a shadow mask such as a metal mask or the like may be used when forming the pattern of the metal electrode grid.

In the manufacturing process described above, because there is no need to laminate a layer for making the metal electrode grid, it is possible to simplify the manufacturing process.

In the case of the metal electrode grid having the structure described in claim 6, it is possible to apply the present invention to a metal electrode grid having any shape.

Compared to the related art structure, the present invention makes it possible to emit electroluminescent light efficiently into the air.

Further, the present invention makes it possible to provide an electrode structure which can avoid voltage drops, and makes it possible to simplify the manufacturing process.

What is claimed is:

1. An electroluminescent light emitting element, consisting essentially of:

a metal electrode layer, a single light emitting layer capable of emitting light by electroluminescence, and a transparent electrode layer laminated on said single light emitting layer and arranged as the outermost layer, provided in that order on a substrate;

wherein the sum of the thickness of said light emitting layer and the thickness of said transparent electrode layer is made thinner than the wavelength of the light emitted by said single light emitting layer and the light emitted by said single light emitting layer is emitted from said transparent electrode layer.

2. An electroluminescent light emitting element, consisting essentially of a single light emitting layer capable of emitting light by electroluminescence, and a transparent electrode layer laminated on said single light emitting layer and arranged as the outermost layer provided in that order on a metal substrate;

wherein the thickness of said transparent electrode layer is made thinner than the wavelength of the light emitted by said single light emitting layer and the light emitted by said single light emitting layer is emitted from said transparent electrode layer.

3. An electroluminescent light emitting element, consisting essentially of a single light emitting layer capable of emitting light by electroluminescence, and a transparent electrode layer laminated on said single light emitting layer and arranged as the outermost layer provided in that order on a metal substrate;

wherein the sum of the thickness of said light emitting layer and the thickness of said transparent electrode layer is made thinner than the wavelength of the light emitted by said single light emitting layer and the light emitted by said single light emitting layer is emitted from said transparent electrode layer.

4. The electroluminescent light emitting element of any one of claims 1 to 3, wherein the top surface of said transparent electrode layer is coated with a nonreflective film.

5. The electroluminescent light emitting element of any one of claims 1 to 3, wherein a metal electrode grid is provided on the top surface of said transparent electrode layer.

6. An electroluminescent light emitting element, consisting essentially of:

a reflection layer, a first transparent electrode layer, a single light emitting layer capable of emitting light by electroluminescence, and a second transparent electrode layer laminated on the light emitting layer and arranged as the outermost layer provided in that order on a substrate;

wherein the thickness of said second transparent electrode layer is made thinner than the wavelength of the light emitted by said single light emitting layer and the light emitted by said single light emitting layer is emitted from said second transparent electrode layer.

7. The electroluminescent light emitting element of claim 6, wherein the top surface of said second transparent electrode layer is coated with a nonreflective film.

8. The electroluminescent light emitting element of claim 6, wherein a metal electrode grid is provided on the top surface of said second transparent electrode layer.

* * * * *